United States Patent [19]

Carte

[11] 4,354,408

[45] Oct. 19, 1982

[54] PLACE MAT PRODUCING AND DISPENSING APPARATUS

[75] Inventor: Clyde R. Carte, Hudson Falls, N.Y.

[73] Assignee: Valcour Imprinted Papers, Inc., Glens Falls, N.Y.

[21] Appl. No.: 186,546

[22] Filed: Sep. 12, 1980

[51] Int. Cl.[3] ..... B26D 7/06

[52] U.S. Cl. ..... 83/162; 83/176; 83/208; 83/259; 83/361; 271/188

[58] Field of Search ..... 83/109, 162, 166, 176, 83/208, 209, 210, 259, 261, 358, 361, 364, 365, 367, 649, 175; 271/188, 209, 251, 254

[56] References Cited

U.S. PATENT DOCUMENTS

| | | | |
|---|---|---|---|
| 2,382,406 | 8/1945 | Engberg | 83/176 X |
| 3,361,021 | 1/1968 | Toth | 83/358 |
| 3,400,622 | 9/1968 | Olsen | 83/210 |
| 3,406,601 | 10/1968 | Clifford | 83/208 X |
| 3,558,109 | 1/1971 | Sofue | 271/188 X |
| 3,559,519 | 2/1971 | Westphal | 83/210 |
| 4,025,187 | 5/1977 | Taylor et al. | 271/10 X |
| 4,151,770 | 5/1979 | D'Angelo et al. | 83/208 X |

*Primary Examiner*—Robert C. Watson
*Assistant Examiner*—Robert P. Olszewski
*Attorney, Agent, or Firm*—Fisher, Christen & Sabol

[57] ABSTRACT

An improved apparatus for producing and dispensing place mats from a roll of sheet material including curved guide member cooperating with said apparatus to receive said place mats and to curl upwardly the side edge portions thereof permitting said place mat to extend outwardly from said apparatus in cantilever fashion to facilitate handling of said place mat as by positioning it on a tray or the like. When the place mat is removed, the apparatus automatically produces another one extending out of the apparatus for easy handling.

10 Claims, 13 Drawing Figures

Fig. 6
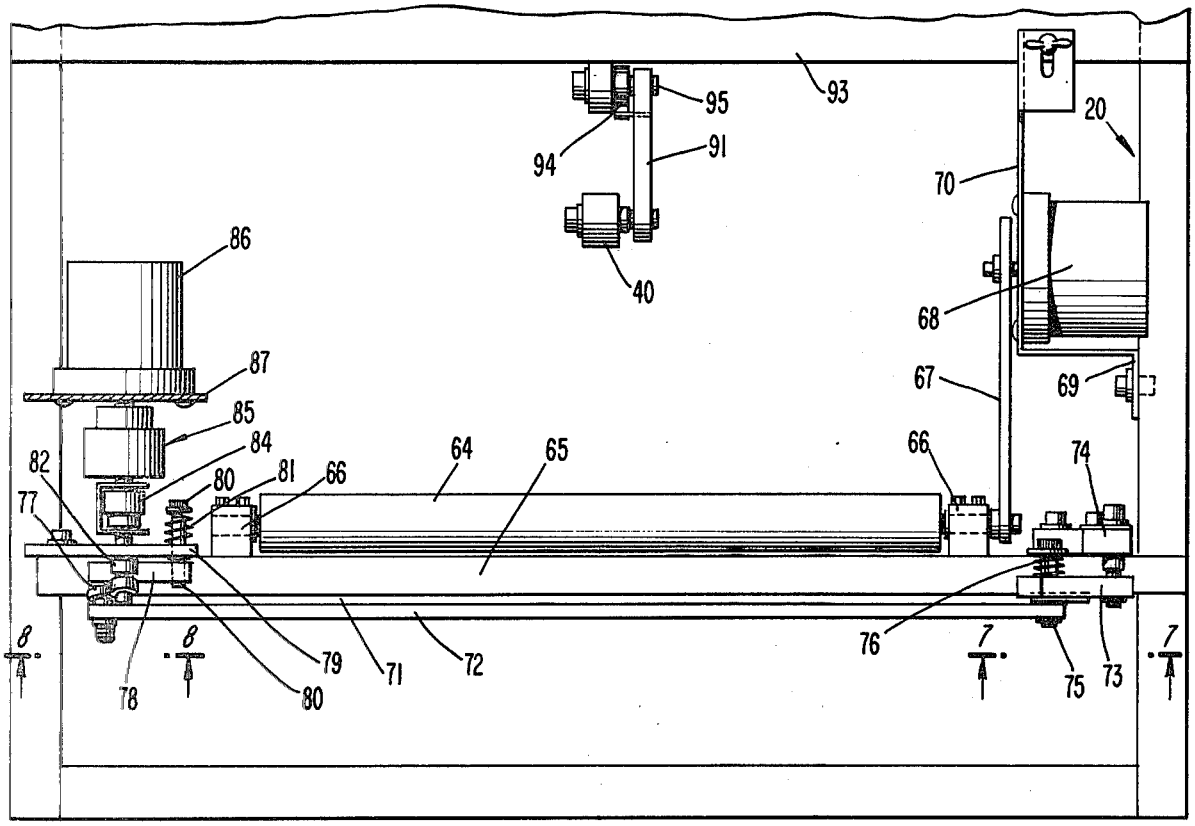
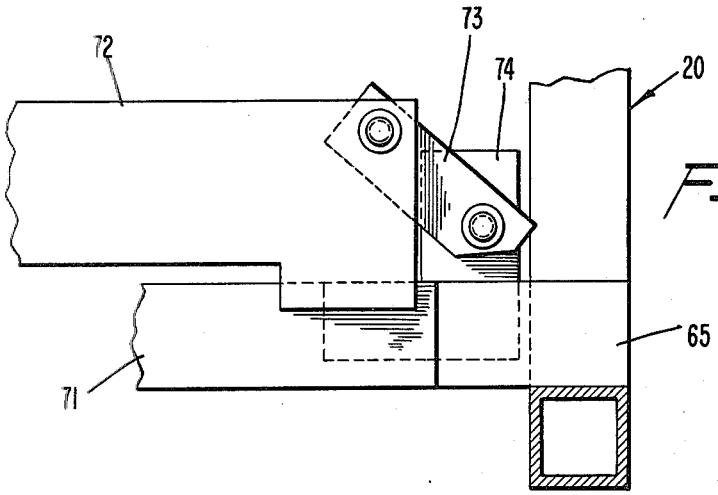
Fig. 7

FIG. 11
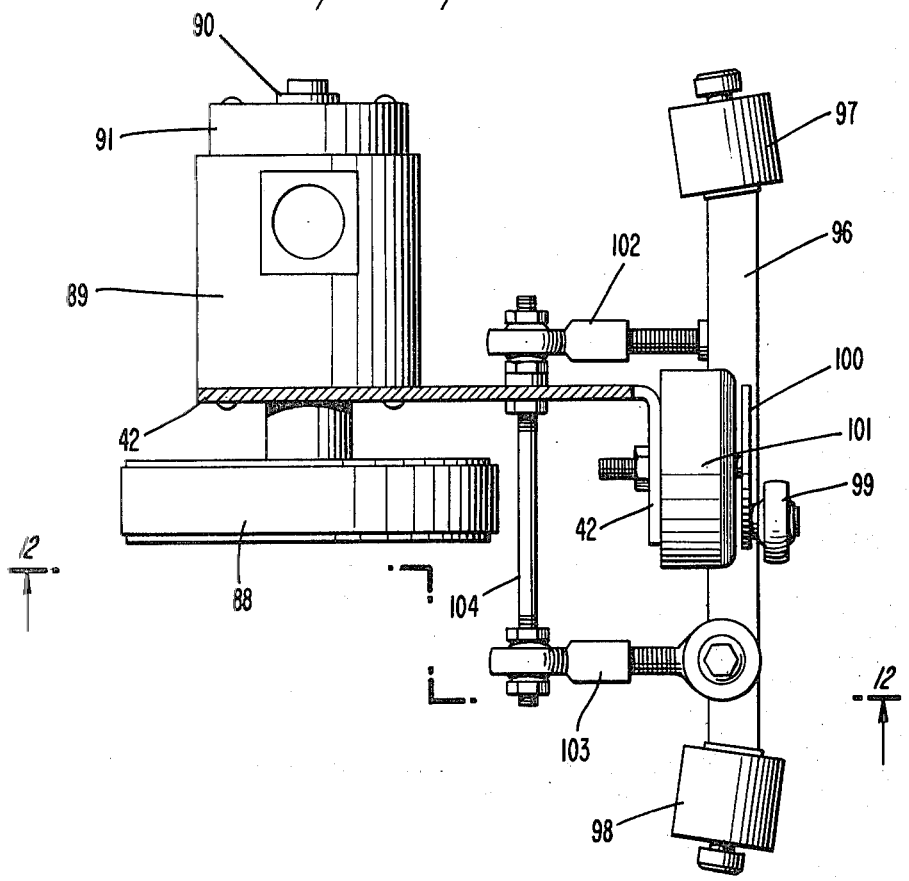
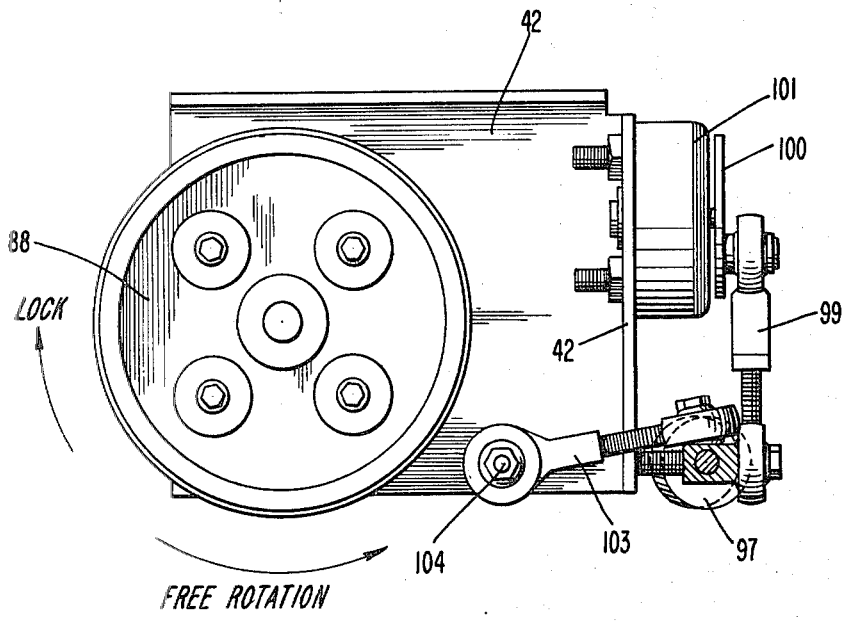
FIG. 12

PLACE MAT PRODUCING AND DISPENSING APPARATUS

This application is related to U.S. Pat. No. 3,361,021, issued on Jan. 2, 1968 to applicant's assignee.

FIELD OF THE INVENTION

This invention relates to the art of sheet feeding and dispensing apparatus and more particularly concerns improved apparatus for cutting individual mats from a paper or plastic web and dispensing the mats one at a time from the apparatus in a manner that facilitates subsequent handling of such mats.

SUMMARY OF THE PRIOR ART

As described in the above-mentioned patent, it has been known heretofore to employ place mats made of polystyrene film or polystyrene foam film for trays used in serving food or beverages. Extensive use has been made of such place mats in airliners where food is served on a large scale. These mats have the desirable characteristic that they tend to cling or stick to the plastic trays, and the dishes and other objects placed on the mat also cling or stick to the mat, due to electrostatic attraction, and thus provides added stability to the food and beverage containers and utensils placed on the mats. This is particularly advantageous in moving vehicles, such as, airliners. However, this characteristic gives rise to considerable difficulty in manipulating and handling the thin place mats when they are supplied in precut stacks. The thin place mats cannot be easily lifted or separated one at a time from the stack because they tend to cling to each other. Also, it is difficult to properly apply the mats to the trays which frequently are also made of plastic because the place mats tend to wrinkle and cling to other objects and articles. Thus, much time and effort must be expended in applying individual place mats to the trays. Where a large number of trays must be lined with place mats quickly, neatly and in unwrinkled condition, the difficulties attendant in applying the mats on the trays become quite frustrating and objectionable.

The apparatus of the above-identified patent provides, for the first time, automatic means for dispensing place mats cut from a supply roll of place mats and presented to the operator through a slot in the apparatus. The previously patented apparatus represented a broad stride forward in solving the above-mentioned difficulties. However, although the previously patented device greatly reduced the difficulties attendant in handling this type of mat, it nevertheless could be improved upon. For example, the cut-off place mat extending out of the prior apparatus tended to droop downwardly which provided some difficulty in properly arranging it on a tray. On occasion, depending upon atmospheric conditions of humidity and temperature, place mats would be dispensed from the prior machine in wrinkled condition or possibly jamming of the prior machine could occur.

SUMMARY OF THE INVENTION

The present invention provides an improved apparatus which presents a place mat extending substantially horizontally out of the apparatus such that the place mat is positioned for easy pick-up by the operator for placement on a tray. The place mat that is dispensed by the apparatus of the present invention is substantially wrinkle-free and the apparatus of the present invention operates in a more reliable manner and avoids frequent jams or other malfunction. The present invention overcomes the above and other difficulties and disadvantages by providing a novel apparatus in which the plastic or paper web wound in a roll is automatically unrolled and transported through the apparatus, an individual place mat is automatically cut off and the mat is disposed in a dispensing position which presents it for easy pick-up and subsequent manipulation.

An object of this invention is to provide an apparatus as described wherein manual removal of an individual mat from the apparatus automatically actuates sheet feeding means to roll the web from the roll and to pass it to a cutting position where a subsequent mat is automatically cut off.

Another object is to provide an apparatus as described including means for measuring the length of the mat withdrawn from the supply roll and a control circuit responsive to said measuring means for actuating the circuit to stop the sheet feeding means and to actuate sheet cutting means when the desired length of place mat has been fed.

A further object is the provision of apparatus described in which the friction acting on the web between the draw roll and the cutting means is significantly reduced and wherein means are provided for stretching the web widthwise to ensure its smoothness when feeding the web to the cutter.

A still further object is to provide a dispensing apparatus capable of dispensing mats of different widths, e.g., 7-7/16 inches to 11¼ inches and having different length as may be required by different tray configurations.

Polystyrene foam sheet from which place mats are made and dispensed pursuant to this invention, is produced continuously by extruding the foam sheet as a tube and slitting the tube longitudinally along both sides. As a result the sheet has the inherent tendency to curl under along its side edges to resume its original tubular shape into which it solidified just after extrusion. This can cause feed problems and further complicates the handling and placement of the mats on trays. The present invention eliminates these problems by providing a feed drive roll that extends almost the full width of the sheet material and canted nip rolls that are positioned to contact the side edge portions of the sheet material to stretch it widthwise. Curling under of the place mat extending out of the apparatus is prevented by providing the mat with a reverse curl, i.e., an upward curl, along its side edges to counteract the under-curling tendency of the sheet material.

The present invention also eliminates the need for utilizing special sensing marks on the sheet material permitting a wider range of ornamentation for the sheet. In addition, the apparatus of the present invention is not subject to over-run of sheet material feed due to inertial over-run of the feed drive motor and also utilizes a much simpler electrical circuitry.

BRIEF DESCRIPTION OF THE DRAWING

FIG. 6 is a fragmentary sectional view taken on line 6—6 of FIG. 2;

FIG. 7 is a fragmentary sectional view taken on line 7—7 of FIG. 6;

FIG. 11 is a fragmentary sectional view taken on line 11—11 of FIG. 2;

FIG. 12 is a fragmentary sectional view taken on line 12—12 of FIG. 11; and

Figure 1:
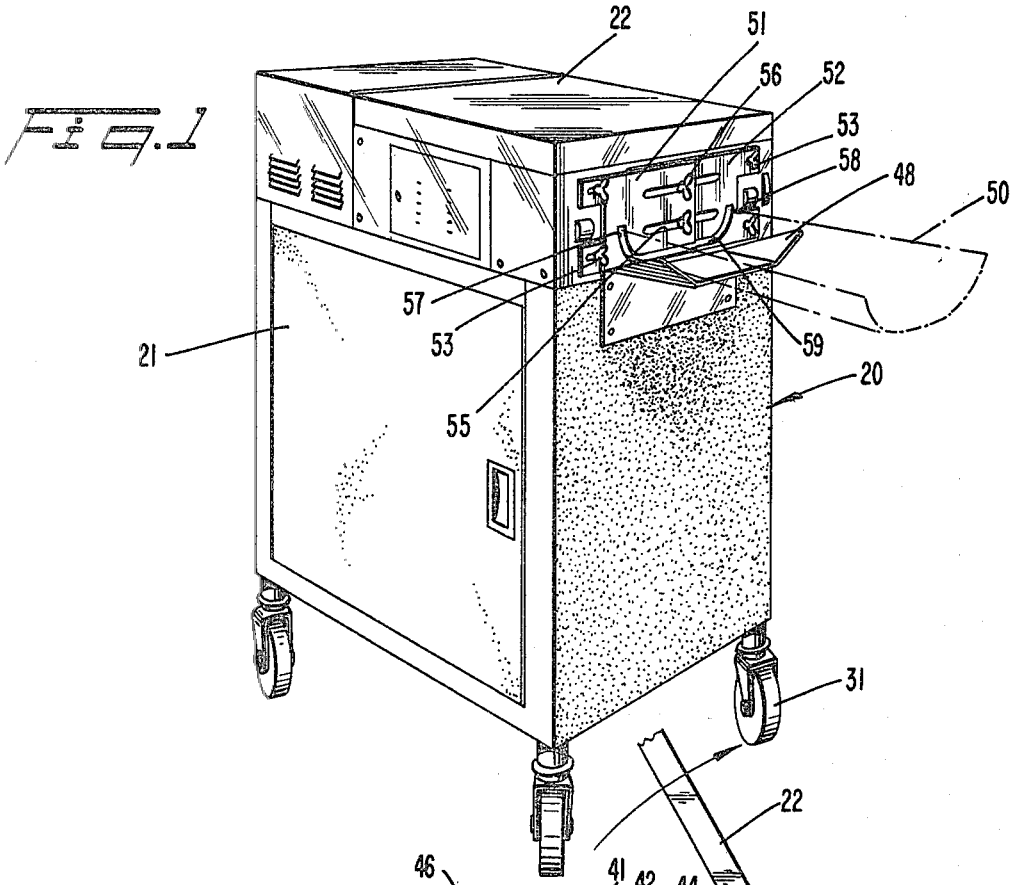
FIG. 1 is a perspective view of an apparatus embodying the invention.
Figure 2:
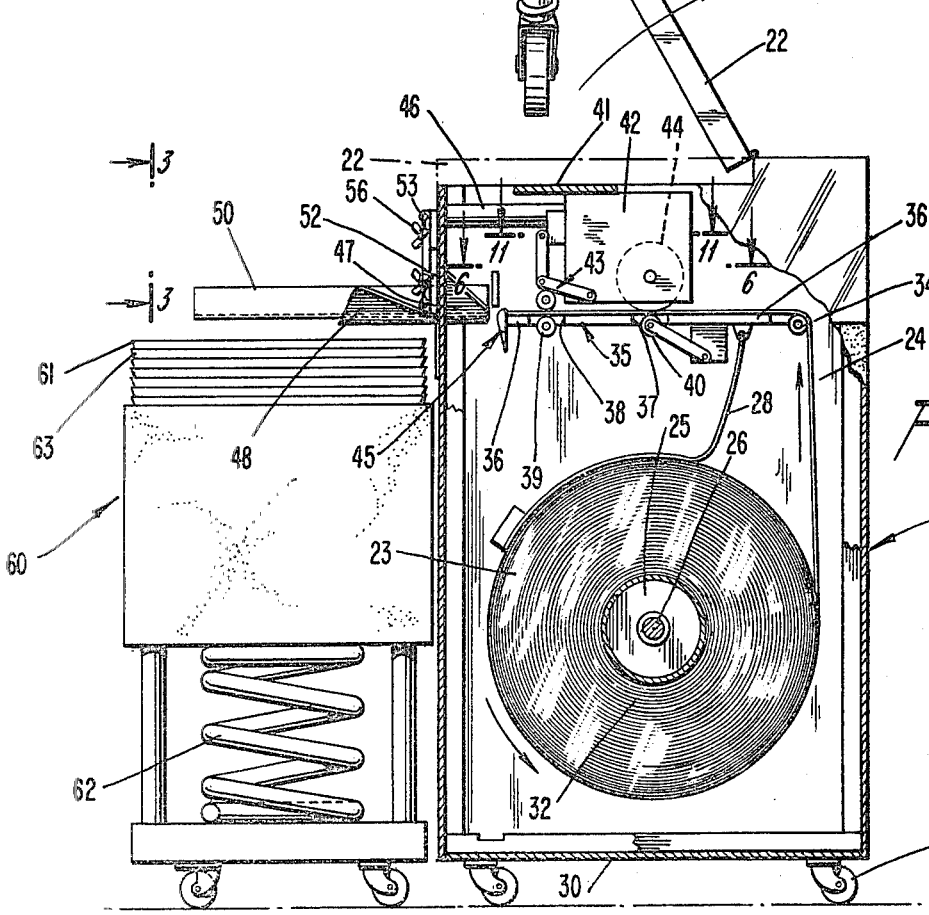
FIG. 2 is a fragmentary, vertical sectional view in side elevation of the embodiment shown in FIG. 1.
Figure 3:
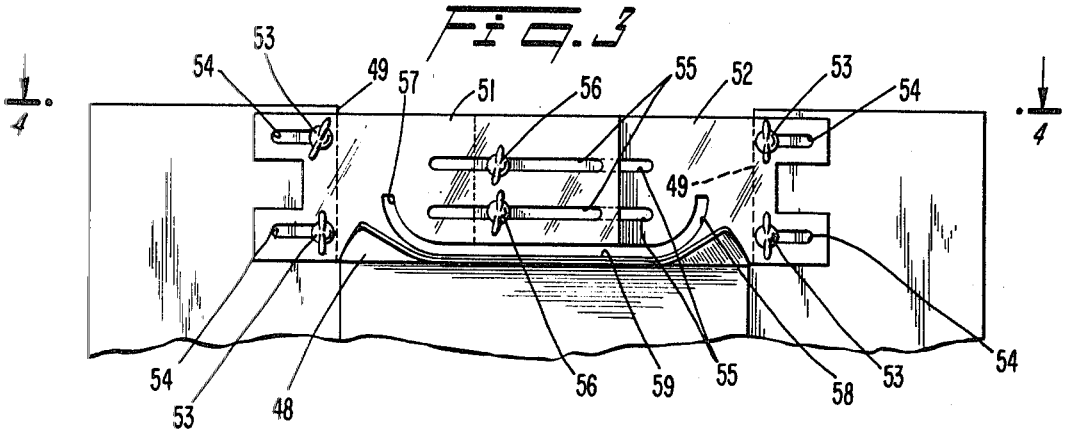
FIG. 3 is a fragmentary sectional view taken on line 3—3 of FIG. 2.
Figure 4:
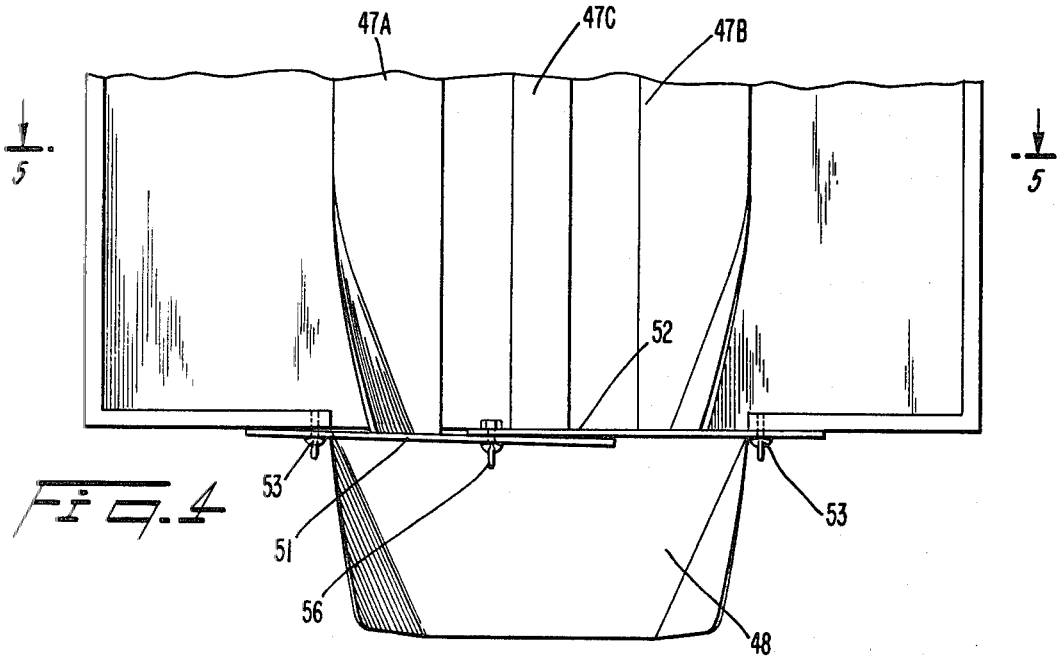
FIG. 4 is a fragmentary sectional view taken on line 4—4 of FIG. 3.
Figure 5:
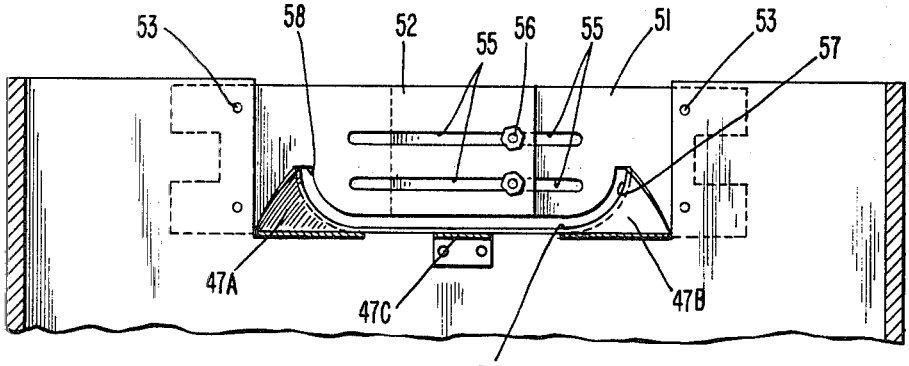
FIG. 5 is a fragmentary sectional view taken on line 5—5 of FIG. 4.
Figure 8:
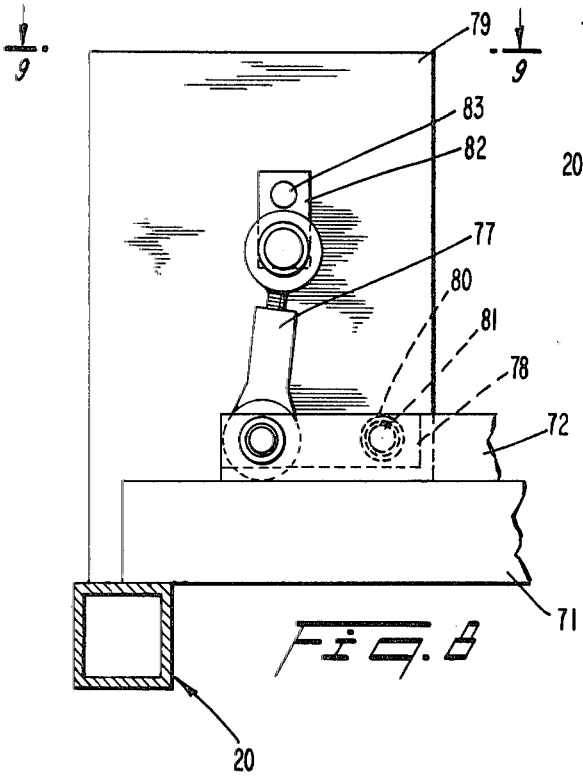
FIG. 8 is a fragmentary sectional view taken on line 8—8 of FIG. 6.
Figure 9:
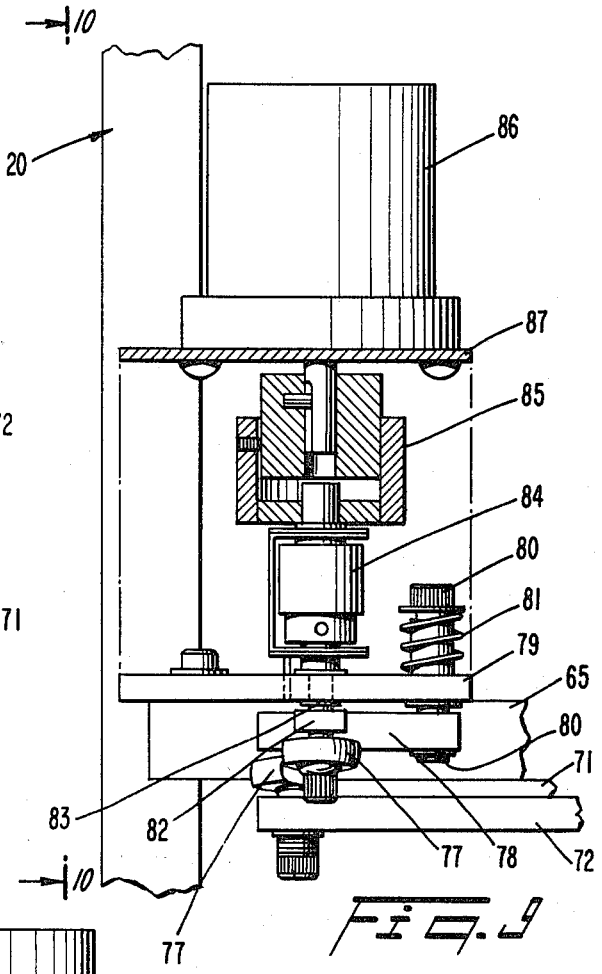
FIG. 9 is a fragmentary sectional view taken on line 9—9 of FIG. 8.
Figure 10:
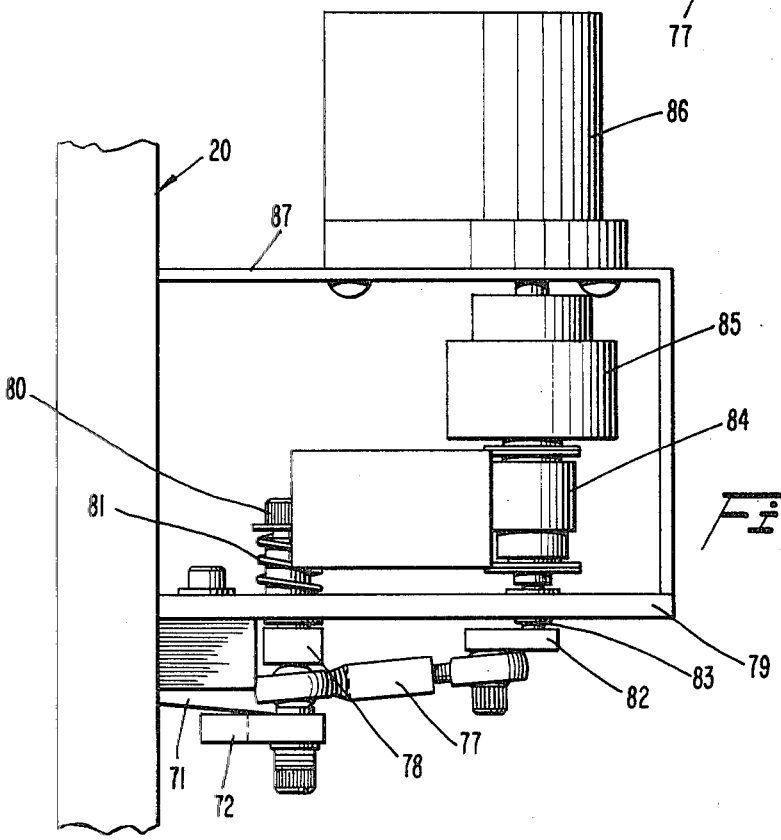
FIG. 10 is a fragmentary sectional view taken on line 10—10 of FIG. 9.

Referring first to FIGS. 1 and 2, there is shown an apparatus embodying the invention, comprising a generally rectangular cabinet 20 having a side door 21 and a cover 22 hinged to the top of the cabinet. Inside the cabinet there is mounted a supply roll 23 of sheet material or web 24, e.g., polystyrene foam 0.005 to 0.011 inch thick. The roll 23 is supported by a spindle 25 which is mounted on a stationary shaft 26. Access to this area is provided through the magnetically latched door 21 on the left hand side of the machine. The wider stock material is positioned on the spindle 25 by pushing the roll 23 all the way back against a square plate at the inner end of the spindle 25. An outer collar 27 is then placed over the spindle 25 and secured snugly against the outer edge of the paper roll 23. A thumb screw (not shown) is provided to hold this ring in place. A spacer ring is placed against the inner plate prior to mounting the narrower, e.g., 7-7/16 inch wide, paper. The roll 23, positioned as described above, will only rotate in the direction shown by the arrow. A weight strap 28 is used to minimize whipping during operation. Paper is fed from the roll 23 under the strap 28 and around and under the roll 23 to the outside of the idler roller 34. The spindle 25 is formed with four bowed springs longitudinally bowed or curved so that they press outwardly on the inside of the roll to keep the roll in position. The bowed springs compensate for differences in internal diameter of different rolls 23. The supply roll mounting structure as described in U.S. Pat. No. 3,361,021, the disclosure of which is incorporated herein by reference, can be used in place of that described hereinabove.

The unit is provided with four locking casters 31 and a 12 inch variable height adjustment feature. When the dispenser is in its lowest position, the height of discharge can be increased as follows. Each caster is adjusted separately by removing 2 bolts from each 2"×2" corner support member in which it is mounted. These bolts are located just above the bottom 30 of the cabinet. The caster 31 is then slid out to the desired length and the bolts are reassembled. Height adjustments can be made in 1" increments.

The web 24 extends upwardly from near the back of the cabinet 20 to a flanged idler roller 34 mounted in the rear upward portions of the cabinet just rearwardly of horizontal table assembly 35. The idler roller 34 keeps the web centered on the table assembly 35 and is mounted by brackets to the rear of said table assembly. The idler roller 34 can be provided with adjustments for adjusting its position relative to the table assembly. The table assembly 35 comprises primarily a table plate 36 having slots 37 and 38 formed therein. Slot 38 provides access for drive roll 39 to contact the underside of the web 24 as it passes over the top of the table. Slot 38 permits access of narrow idler roller 40 to engage the undersurface of web 24 as it passes over the top of table plate 36.

A cross piece or bridge 41 extends across the top of cabinet 20 and supports bracket 42 on which are mounted retractable pressure roller assembly 43 and web length measuring assembly 44. The bridge 41 is hinged at each end of its forward edge to the top of the cabinet 20. Two toggle clamps are provided at each end of the rearward edge of bridge 41 and are connected to the top of the cabinet 20 so that when released the bridge 41 and attached components can be pivoted upwardly approximately 15° to facilitate feeding the web forward through the cut-off knives and out of the discharge opening in the front of the unit. The bridge 41 is then lowered and secured in place by re-clamping the toggle clamps to re-engage the web length measuring assembly 44 and the retractable pressure roller assembly 43 with the top surface of the web 24. Also mounted on the sides of the cabinet in its upper portions are cutter assembly 45 and photoelectric cell 46. Also mounted on the upper inside front wall of cabinet 20 is an internal curved web guide plate 47 which is alined with table plate 36 at the same level of said table plate to receive the web from table plate 36 and curl it along its side edge portions as shown in FIG. 1. There is also mounted on the upper external front wall of cabinet 20 an external curved web guide plate 48 alined with the internal curved web guide plate 47 to receive the web from said internal plate 47.

A rectangular section 49 is cut out of the upper front wall of cabinet 20 to permit the web 24 to extend outwardly from cabinet 20 and to permit external dispensing of the place mat 50 after knife assembly 45 has operated to sever place mat 50 from web 24. Two guide slot plates 51 and 52 are mounted to the front wall of the cabinet on each side of rectangular cut-out section 49 by means of wing bolts 53 which pass through slots 54 formed in one end of each plate 51, 52 and are threaded into the front wall of the cabinet. The other end of each of guide slot plates 51, 52 are formed with long slots 55 through which wing bolts 56 pass for connecting the two guide plates 51 and 52 together. The guide slot plates 51 and 52 are each formed with curved slots 57, 58 also which, when both plates 51 and 52 are joined, form a curved guide slot 59, the intermediate portions of which are horizontal and the end portions of which are curved to a substantially vertical end portion. The web 24 is guided through the curved guide slot 59 by means of internal guide plate 47A and 47B connected to the internal faces of plates 52 and 51, respectively, so that the web is curved upwardly along its side edge margins, thus, imparting sufficient rigidity to the curved web whereby it can be supported in cantilever fashion by curved guide slot 59 and external curved web guide plate 48 even when the mat 50 is severed from web 24. Internal guide plate 47C is mounted to the cabinet 20 and supports the central part of the web as it moves from the knives to the slot 59. This enables the mat 50 to extend a substantial distance out of the cabinet 20 and permits the positioning of a tray or other object under the mat 50 when it is desired to use the mat.

By loosening the wing bolts 53 and 56, the guide slot plates 51 and 52 and plates 47A and 47B can be moved inwardly to accommodate narrower web 24 or outwardly to accommodate wider web 24. The wing bolts are tightened after the desired width has been obtained.

FIG. 2 illustrates also the use of a tray dispensing device 60 which is designed to maintain the uppermost tray 61 in a predetermined position beneath the web 50 which extends in cantilever fashion out of the cabinet 20. As the uppermost tray is removed, the decrease in weight permits spring mechanism 62 to move the remaining trays 63 one notch upward to maintain a new uppermost tray at essentially the same height as the previous uppermost tray.

FIG. 6 illustrates the drive roller mechanism and cutter mechanism in a plan view. A drive roller 64 is mounted on a cross beam 65 by means of bearings mounted in brackets 66. The drive roller 64 is driven by belt 67 which is driven by variable speed motor 68 mounted in the cabinet by bracket 69 and adjustable bracket 70 which permits adjustments to the tension of belt 67.

The variable speed motor 68 is controlled by a rheostat so that the speed by which the web 24 is fed can be speeded up to match the speed of a fast operator.

The cutter assembly shown in FIGS. 6, 7, 8, 9 and 10 comprises a stationary knife 71 mounted on cross beam 65 with its upper knife edge substantially flush with the upper surface of cross beam 65. A movable knife 72 is pivotally mounted on cross beam 65 at one side of the cabinet 20 above stationary knife 71. An idler arm 73 is pivotally mounted on movable knife 72 and also pivotally connected to an upright bracket 74 which is mounted on the cross beam 65. The idler arm is pivotally connected to the movable knife by means of pivot pin 75 and is spring-biased into contact with the movable knife 72 by means of coil spring 76 around pivot pin 75.

The other end of movable knife 72 is pivotally connected to one end of rod 77 which end is also pivotally connected to actuating arm 78. The other end of actuating arm 78 is pivotally connected to upright bracket 79 which is mounted on the cross beam 65. A pivot pin 80 is used to pivotally mount the actuating arm 78 on bracket 79 and a coil spring 81 on pivot pin 80 urges movable knife 72 toward stationary knife 71. The other end of rod 77 is pivotally connected to one end of eccentric arm 82. The other end of eccentric arm 82 is mounted on and keyed to the shaft 83 of a single revolution clutch 84 which is drivably connected through coupling collar and hub assembly 85 to a variable speed gear motor 86 which is mounted on bracket 87. The single revolution clutch 84 is one of the well known types that is adapted to make a single revolution when the motor 86 is actuated and to reset itself for the next revolution when the gear motor 86 is de-activated. A solenoid, such as the one described in U.S. Pat. No. 3,361,021, if desired, can be employed for actuating the movable knife blade, if desired.

Referring to FIGS. 2, 6, 11, and 12, the retractable pressure roller assembly 43 and web length measuring assembly 44 are illustrated. The web length measuring assembly includes a measuring wheel 88 mounted on a shaft encoder 89 which is mounted on bracket 42 which is connected to cross piece 41. A roller clutch 90 is mounted on the encoder 89 by means of roller clutch mounting plate 91. The roller clutch 90 is installed so that the wheel 88 freely rotates in a counterclockwise direction (as viewed in FIG. 12) and is locked against movement in the clockwise direction (as viewed in FIG. 12). The free rotation of wheel 88 in a counterclockwise direction enables the rotation of said wheel 88 by the web passing under the wheel to operate the encoder so that the length of web travelling beneath the wheel 88 is sensed by the encoder. The locking feature prevents inadvertent misalignment of the radial position of wheel 88 in relation to the length of web being fed. Narrow idler roller 40 is alined under wheel 88 and is pivotally mounted by means of pivot arm 91 to a cross beam 93 extending from side to side in the cabinet. The pivot arm is biased upwardly by means of coil spring 94 mounted on pivot pin 95 by which the pivot arm 91 is pivotally connected to the cross beam 93. This causes the narrow idler roller 40 to bear upwardly on the undersurface of the web and force it into tight contact with wheel 88 in order to cause said wheel 88 to turn by web movement in the forward direction.

The retractable pressure roller assembly 43 is also best shown in FIGS. 2, 11 and 12 and is shown as comprising an axle 96 on the ends of which are mounted pressure rollers or nip rolls 97. As shown, the pressure or nip rolls 97, 98 are canted outwardly for the purpose of stretching the web passing under the rollers in a widthwise direction in order to ensure a flat, smooth, wrinkle-free condition for the web when the knife cutter is actuated to sever the place mat from the web. The axle 96 is pivotally connected to one end of rod 99 which has a bearing at each end. The opposite end of rod 99 is pivotally connected to an eccentric member 100 which is rotably mounted on rotary solenoid 101 which is mounted on bracket 42. The end of rod 99 is eccentrically mounted on eccentric member 100 such that rotation of said eccentric member by rotary solenoid 101 causes the rod to move up and down. The axle 96 is stabilized by stabilizing rods 102 and 103 having bearings at each end, the forward end of said stabilizing rods being pivotally connected to the axle 96 on each side of rotary solenoid 101. The respective other ends of stabilizing rods 102, 103 are pivotally mounted on stabilizing shaft 104 which is fixed to the bracket 42. Actuation of rotary solenoid 101 rotates the eccentric member 100 to lower rod 99 thereby lowering axle 96 to bring nip rolls 97, 98 into contact with the web 24 passing beneath said nip roll to force said web into contact with drive roller 64 which advances the web from the supply roll 23 through the apparatus and out of curved guide slot 59.

The photoelectric cell 46 senses the absence of a mat 50 supported by internal and external curved web guide plates 47 and 48 and provides a signal which activates rotary solenoid 101 to rotate to lower the axle 96 and nip rolls 97, 98 bringing them into pressure contact with the web 24 beneath said nip rolls to force the web into pressure, friction contact with drive roller 39 which may be continuously driven by motor 68 or which may be intermittently rotated at such time that photoelectric cell 46 senses the absence of a place mat on the internal web guide plates 47A, B and C and at such time as rotary solenoid 101 is activated. This causes the web 24 to advance through the cutter assembly 45 and onto internal web guide plates 47A, B and C through curved guide slot 59 onto external curved web guide plate 48. The guide plates 47A and B and 48 and guide slot 49 cause the web 24 to curl upwardly along its side edge portions thereby imparting substantial rigidity to the web 24, such that it is able to extend outwardly, horizontally beyond guide plate 48 in cantilever fashion without drooping over the outer edge of guide plate 48.

Figure 13:
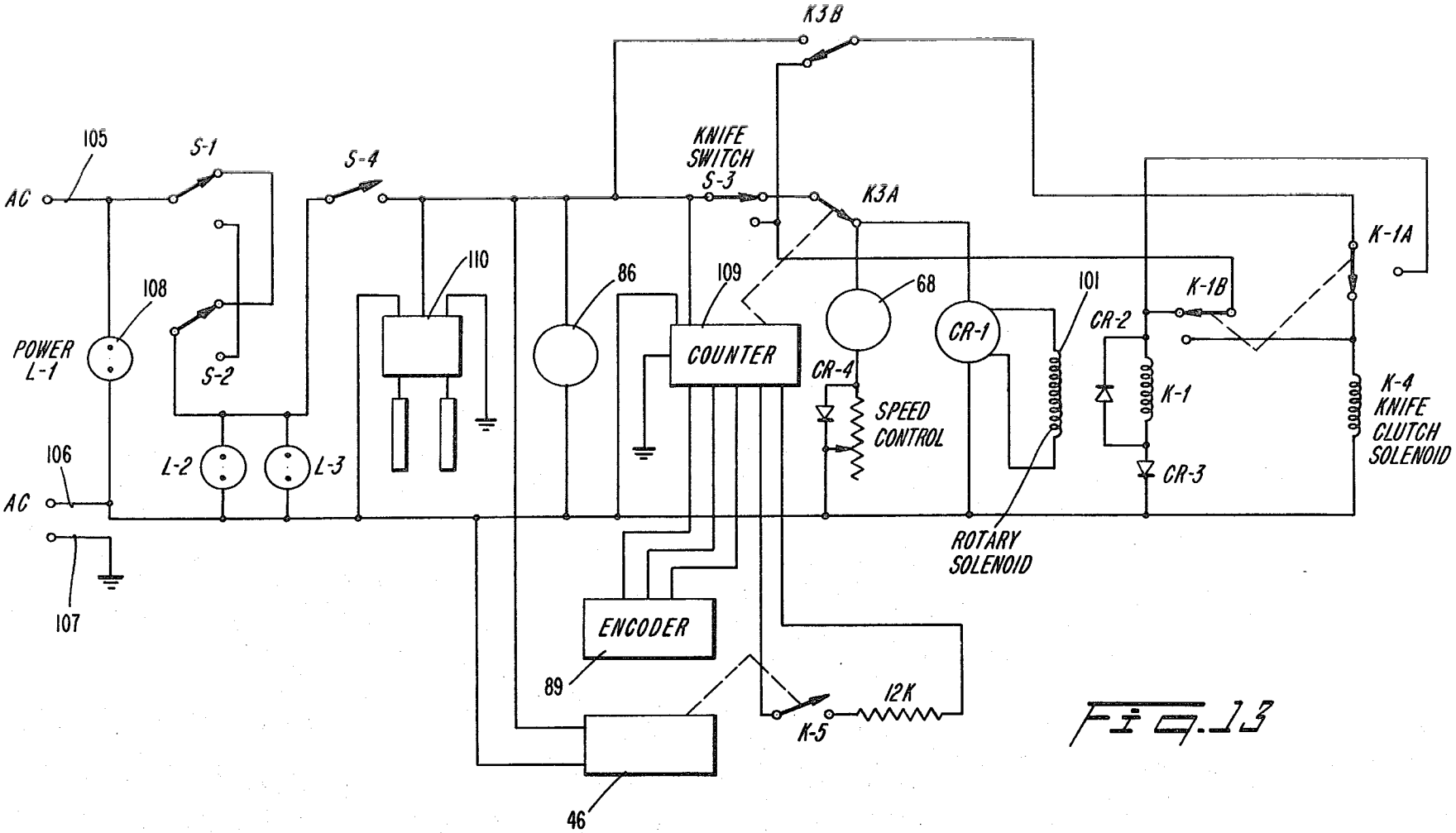
FIG. 13 is a diagram of an electric circuit used in the apparatus shown in FIGS. 1–12.

FIG. 13 illustrates a circuit diagram of the electrical components which control the operation of the apparatus illustrated in FIGS. 1 through 12. The circuit includes a power supply cord comprising two power wires 105 and 106 and a ground wire 107, a power-on light 108, a fuse (not shown), two on-off run switches S-1 and S-2, two running lights L-2 and L-3 and other components as described above. The switches S-1 and S-2 are mounted on the front of cabinet 20 one on each side of the guide slot 59 so that the machine can be started and turned off from each side of the front of the machine. Similarly, the running lights L-2 and L-3 are mounted on the front panel on each side of slot 59. The circuit also includes a cover safety switch S-4 which disconnects power from all the remaining components from the machine when the cover is raised. The knife drive motor 86 is wired in so that it continues to rotate while the apparatus is supplied with power and until it is shut down by disconnecting it from power or by operation of switches S-1, S-2 or S-4. The actual operation of the knife is controlled by clutch solenoid K-4 which causes single revolution clutch 84 to engage to rotate eccentric arm 82 one revolution. An electronic counter 109 is connected to power lines 105, 106 and is fed with impulses generated by encoder 89 responsive to the length of web that passes under measuring wheel 88. The photoelectric cell 46 is also connected to the power lines 105, 106 and operates photo relay K-5 which initiates the operation of the electronic counter 109. The drive roller motor 68 is also connected to power lines 105, 106 through knife switch S-3 and control counter relay K-3A. Rheostat Cr-4 is provided in the circuit in motor 86 for the purpose of varying the speed of drive roller 64. In a similar manner, rectifier CR-1 is connected to the power lines through knife switch S-3 and control counter relay K-3A contacts. The rotary solenoid 101, which raises and lowers the pressure (nip) rollers 97, 98, is powered by rectifier CR-1. Latching relay K-1 is also connected to lines 105 and 106.

The operational sequence once the unit is turned on is described hereinafter. Initially, the control counter 109 is set to its zero condition. Also the knife drive motor 86 begins to rotate and continues to rotate until power is turned off. The actual cutting is controlled by the knife clutch solenoid K-4 which controls the single revolution clutch 84. Initially, the knife switch S-3 is in the position shown in FIG. 13 and supplies power to the counter control relay contact K-3A which supplies power to drive roller motor 68 and through rectifier CR-1 supplies power to rotary solenoid 101 activating it and lowering nip rolls 97, 98 into contact with the web 24 which causes it to contact feed roller 64 resulting in the forward movement of web 24. As the web 24 moves forwardly it turns measuring wheel 88 which rotates shaft encoder 89 which sends electric impulses that are proportional to the length of web 24 passing under measuring wheel 88 to control counter 109 which, in turn, counts the number of impulses. While the control counter is counting it also displays the number of impulses it has received in the particular cycle. The number of impulses corresponding to the desired length of web has been preset into the counter. When the number of impulses counted by the counter 109 is equal to the preset number, the counter display is immediately and automatically reset to zero (actually the display at the end of the cut is a small number above zero because of over-travel of the web after the cut command is received and before it is carried out). At the same time, counter relay K-3 is energized to open contacts K-3A and to move contacts K-3B from that position shown in FIG. 13 to the upper position which by-passes knife switch S-3. This begins the cut sequence by supplying power through switch K-3B and relay contacts K-1A to the knife clutch solenoid K-4 causing clutch 84 to engage providing rotation to eccentric arm 82 which causes movable knife blade 72 to pivot downwardly and cut the measured length 50 of web from the supply roll 23. As the movable knife 72 begins to pivot downwardly, switch S-3 is released and moves to the opposite contact, i.e., the lower contact as shown in FIG. 13. When the knife switch S-3 has changed contacts it supplies power to relay coil K-1 through relay contacts K-1B causing relay K-1 to energize thereby moving contacts K-1A and K-1B to their respective positions opposite to those positions shown in FIG. 13. This causes power to be supplied through relay contacts K-3B and K-1A to relay coil K-1 to keep it latched. In addition, power is now supplied to the knife clutch solenoid K-4 through switch S-3 and relay contacts K-1B. The clutch solenoid K-4 remains engaged until the movable knife 72 has completed its downward movement and upward movement to its uppermost position in which it causes knife switch S-3 to return to its original position as shown in FIG. 13 thereby removing power from the knife coil clutch K-4.

The relay K-1, however, remains energized holding contacts K-1A and K-1B in position opposite to those shown in FIG. 13 and will remain energized until it is reset by removing power from the control counter relay K-3. This prevents more than one cut occurring upon each "cut" command. Furthermore, the function of knife switch S-3 is to ensure that the web 24 will not begin to feed forward until the movable knife 72 has returned to its uppermost rest position. In the event the apparatus is shut off in the middle of a "cut" cycle, it will complete that cycle when turned on again before feeding any additional web.

The reset of the control counter 109 occurs when the place mat severed from the roll and resting on guide plates 47A, B and C is removed. Photoelectric cell 46 shines a light downwardly toward a reflective target located under the web resting on the guide plates 47A, B and C. When the target is blocked by the place mat 50 nothing occurs. When the place mat 50 is removed, the photoelectric cell 46 receives reflected light sensing the absence of web or place mat on said guide plates and the photoelectric relay K-5 is energized. This closes contacts K-5 and provides a relay reset signal through a 12 Kohm resistor to control counter 109 thereby de-energizing relay K-3 and in turn de-energizing relay K-1. The contacts K-3A and K-3B and K-1A and K-1B are thus returned to their respective original positions as shown in FIG. 13. Paper is fed again until measuring wheel 88 causes encoder 89 to emit sufficient impulses which correspond to the desired web length and counter 109 actuates relay K-3 to cause the contacts K-3A and K-3B to move to the positions opposite that shown in FIG. 13. The purpose of the 12 Kohm resistor is to provide a slight delay between the removal of the place mat 50 and the re-start of the paper feed. This ensures that no matter how fast the place mats 50 are removed the movable knife 72 will always have time to complete its cycle before additional web 24 is advanced past the knife blades 71, 72, thus ensuring a minimization of jam-ups.

FIG. 13 also illustrates the use of a static eliminator generator 110 connected to the power lines 105, 106. The web 24 tends to generate a static charge and when made of plastic, such as polystyrene foam, it generates a static charge which can cause handling problems. Therefore, static eliminator rods are preferably incorporated into the apparatus just in front of the cut-off knives 71, 72 which rods are powered by the generator 110 to provide a flow of ionized air which tends to remove the static charge from the web allowing it to be handled more efficiently. In addition, the external, curved web guide plate 48 is preferably coated with Teflon to minimize the built-up of static charges in the web 24 after it has passed between the static eliminator rods and prior to being cut-off to length.

The encoder 89 can be adjusted to vary the length of web advanced before cut-off. When the predetermined length of web has been advanced, the counter causes activation of the rotary solenoid 101 to raise the axle 96 and nip rolls 97 to allow the web 24 to retract out of frictional driving contact with drive roller 64. At the same time, the knife clutch 84 is energized to cause the movable knife blade 72 to move downwardly and sever the web to separate a place mat of the predetermined length from the remaining portions of the web and to then move said movable knife to its uppermost, rest position where it is in position to sever the next measured length upon command from the counter 109.

What is claimed is:

1. In an apparatus for dispensing place mats of thin sheet material from a supply roll of a web of said sheet material, including (a) a support;

(b) means for mounting said supply roll on said support;

(c) a horizontal, substantially planar table carried by said support;

(d) drive roll means operating on said web in a substantially planar condition for drawing said web of said sheet material in a forward path over said table;

(e) a motor for driving said drive roll means;

(f) cutter means disposed at the forward end of the table to cut off a predetermined length of said web, said length constituting one of said mats, the improvement comprising (g) curved guide means positioned forward of said cutter means and cooperating with said table to receive said length of web and curl upwardly the side margins of said length of web enabling said web to extend substantially horizontally outwardly from said apparatus in cantilever fashion with its inner end supported by said curved guide means, said drive means maintaining said web in a flat condition when cut by said cutter means and said curved guide means curling said side margins after said web has passed said cutter means.

2. The improvement as claimed in claim 1 wherein said drive roll means comprises (1) a drive roller adjacent one surface of said web;

(2) at least one retractable pressure roller adjacent the opposite surface of said web, said pressure rollers being movable into contact with said web to force it into contact with said drive roller for drawing said web from said supply roll over said table and being retractable to a non-contact position to cease the drawing of said web from said supply roll and (3) means for moving said pressure roller into and out of pressure-bearing contact with said web.

3. Improvement as claimed in claim 2 wherein said drive roll means comprises a drive roller beneath said web, and two retractable pressure rollers each positioned above said web and drive roller at each side thereof, said retractable pressure rollers being canted outwardly whereby said web is stretched widthwise when said canted retractable pressure rollers press said web into driving contact with said drive roller.

4. Improvement as claimed in claim 3 wherein said drive roll means for drawing said web from said supply roll is located adjacent said cutter means.

5. Improvement as claimed in claim 4 wherein said drive roller is adapted to rotate continuously.

6. Improvement as claimed in claim 1 including (h) measuring means for measuring the length of said web being drawn and, when said predetermined length of said web has been drawn, providing a signal to actuate said means for moving said retractable pressure rollers thereby moving said pressure rollers out of contact with said web, and to actuate said means for operating said cutter means to sever said predetermined length.

7. Improvement as claimed in claim 6 wherein there is provided (i) switch means actuated by the absence of a cut-off mat in said apparatus whereby manual withdrawal of the cut-off mat operates said switch means to activate said means for moving said retractable pressure rollers to lower same to press said web against said drive roller and to energize said drive motor to drive said drive roller and draw an additional length of web from said supply roll.

8. Improvement as claimed in claim 7 including (j) time delay means to delay activation of said means for moving the pressure rollers and energization of said drive motor for a sufficient time to permit said cutter means to complete the severing of the web and reset for severing the next web.

9. Apparatus for dispensing place mats made of thin polystyrene foam web, comprising (a) a support;

(b) means for mounting a supply roll of said web on said support;

(c) a substantially planar table mounted by said support;

(d) drive means operating on said web in a substantially planar condition for drawing said web in a forward path over said table comprising (1) a drive roller adapted to contact the underside of said web, and (2) two pressure nip rolls positioned to contact the upper surface of said web to press said web into driving contact with said drive roller, each said nip roll being located adjacent the side edges of said web and being canted outwardly in the direction of forward travel of said web to stretch said web widthwise;

(e) means for lowering and raising said nip rolls into and out of contact with said web;

(f) a drive motor for driving said drive roller;

(g) cutter means disposed at the forward end of said table to cut-off a predetermined length of said web, said length constituting one of said mats, the drive roller and nip rolls of said drive means being located close to said cutter means to maintain said web in a flat condition when cut by said cutter means;

(h) curved guide means positioned forward of said cutter means and cooperating with said table to receive said length of web and curl upwardly the side margins of said length of web after it has moved past said cutter means, enabling said web to extend substantially horizontally outwardly from said apparatus in cantilever fashion with its inner end supported by said curved guide means;

(i) sensing means disposed to sense the absence of a place mat or web forward from the cutter means, said sensing means providing a signal when no place mat or web is sensed forward from the cutter means, said signal actuating said lowering and raising means to lower the idler rolls into pressure contact with the web forcing said web into driving contact with said drive roll and energizing said drive motor to advance said web past the cutter means and into the curved guide means; and (j) length measuring means providing a signal when a predetermined length of web has advanced said cutter means, said signal from said length measuring means actuating said lowering and raising means to raise said idler rolls out of contact with said web to cease the advancement of said web, said signal from said length measuring means also actuating said cutter means to sever said web thereby providing a place mat having its side edge portions curled upwardly and extending substantially horizontally outwardly from said apparatus in cantiliever fashion.

10. Apparatus as claimed in claim 9 including (k) time delay means acting on said signal from said sensing means to delay actuation of said raising and lowering means and energization of said drive motor for a sufficient time to permit said cutter means to complete the severing of said web and reset for severing the next web.

* * * * *